US006158072A

United States Patent [19]

Baek et al.

[11] Patent Number: 6,158,072

[45] Date of Patent: Dec. 12, 2000

[54] METHOD FOR DETECTING CLOTH AMOUNT IN DRUM WASHING MACHINE

[75] Inventors: Seung Myun Baek; Seung Taek Baek; Jeong Hyun Lim, all of Kyungsangnam-do, Rep. of Korea

[73] Assignee: LG Electronics Inc., Seoul, Rep. of Korea

[21] Appl. No.: 09/515,627

[22] Filed: Feb. 29, 2000

Related U.S. Application Data

[62] Division of application No. 09/113,902, Jul. 13, 1998, Pat. No. 6,029,299.

[30] Foreign Application Priority Data

Jul. 14, 1997 [KR] Rep. of Korea ..... 97-32549
Mar. 10, 1998 [KR] Rep. of Korea ..... 98-7957

[51] Int. Cl.[7] ..... D06F 33/02

[52] U.S. Cl. ..... 8/159; 68/12.04; 68/12.06

[58] Field of Search ..... 8/159; 68/12.04, 68/12.06, 12.12, 12.14

[56] References Cited

U.S. PATENT DOCUMENTS 3,152,462 10/1964 Elliott et al. ..... 68/12.02
3,226,016 12/1965 Couper et al. ..... 68/23.3
3,430,852 3/1969 Lenkey et al. .
3,674,419 7/1972 Tichy .
4,096,988 6/1978 Scuricini .
4,435,392 3/1984 Tatsumi et al. .
4,522,620 6/1985 Leister .
4,782,544 11/1988 Nystuen et al. ..... 68/12.14
4,910,502 3/1990 Serveau et al. .
5,070,565 12/1991 Sood et al. .
5,233,847 8/1993 Tanaka ..... 68/12.04
5,375,282 12/1994 Dausch et al. .

FOREIGN PATENT DOCUMENTS 61-40856 9/1986 Japan ..... 68/23.3
147682 7/1987 Japan ..... 68/12.04
2-249595 10/1990 Japan ..... 68/12.04

*Primary Examiner*—Philip R. Coe
*Attorney, Agent, or Firm*—Fleshner & Kim, LLP

[57] ABSTRACT

Methods of detecting a load level in a washing machine include monitoring a rotational speed of a motor of the washing machine for a period of time after the motor has reached an operating speed. In a first method embodying the invention, the number of rotational speed peaks that occur in each of a plurality of speed bands are detected during the period of time. The detected number of speed peaks in each speed band are compared to reference count numbers corresponding to each of the speed bands, and a load level in the washer is determined based on the comparisons. In a second method embodying the invention, the number of times that the rotational speed of the motor exceeds a predetermined speed during a predetermined period of time is detected. The detected number is then compared to reference count numbers, and the load level in the washing machine is determined based on the comparison. This process may be repeated several times if a sensed eccentricity of the washing machine exceeds a predetermined level of eccentricity. If the process is repeated several times, the count value during each repetition may be stored in a different count variable. Then, during one of the repetitions, a sum of two or more count values may be compared to reference count values to determine a load level in the washing machine.

10 Claims, 6 Drawing Sheets

METHOD FOR DETECTING CLOTH AMOUNT IN DRUM WASHING MACHINE

This application is a Divisional of application Ser. No. 09/113,902 filed Jul. 13, 1998, and now U.S. Pat. No. 6,029,299.

BACKGROUND OF THE INVENTION

1. Field of the Invention

The present invention is related to a method for detecting an amount of cloth in a drum washing machine, and more particularly, to a method for detecting an amount of cloth in a drum washing machine, in which a change in revolutions per minute of a motor(RPM) is measured for a preset duration in a disentangle step in a spinning cycle for detecting an amount of cloth.

2. Discussion of the Related Art

As shown in FIG. 1, a background art washing machine has a driving circuit, provided with a motor 3 adapted to be driven by a driving power fed externally for transmission of a rotating power to a drum, a speed sensing unit 4 for sensing a rotating speed of the motor 3, a computing/controlling unit 1 for receiving a signal detected in the speed sensing unit 4, selection signals from a key pad(not shown) and sensed signals generated in different sensors(not shown) and providing lot of signals, and a motor driving unit 2 for rotating the motor 3 either in a regular or reverse direction in response to a control signal from the computing/controlling unit 1.

Washing cycle and spinning cycle of the drum washing machine conducted by the foregoing driving circuit will be explained.

In the washing cycle, the computing/controlling unit 1 receives the rotating speed of the motor 3 through the speed sensing unit 4, selection signals from the key pad, and sensed signals of different sensors and provides lots of control signals according to the received signals. The control signals from the computing/controlling unit 1 switches the motor driving unit 2 so that a regular direction current is applied to the motor 3 to rotate the motor 3, a rotation force of which motor 3 is transmitted to a pulsator (not shown) through a clutch, to rotate the pulsator. As a result of pulsator rotation, a mechanical friction is occurred between the laundry in the drum and the pulsator. The computing/controlling unit 1 keeps on controlling the motor 3 for a preset time period such that the motor 3 is rotated in a regular direction at a preset RPM. Then, after a preset time period, the motor 3 is turned off for a preset time period again for decelerating and stopping the motor 3. Next, when the motor 3 comes to a stop, the computing/controlling unit 1 provides a control signal for switching the motor driving unit 2 to apply a reverse direction current to the motor 3. Then, the motor 3 is rotated in a reverse direction, selectively transmitting a rotation force to the pulsator through the clutch, to rotate the pulsator. As a result of pulsator rotation, a mechanical friction is occurred between the laundry in the drum and the pulsator. The computing/controlling unit 1 keeps on controlling the motor 3 for a preset time period such that the motor 3 is rotated in a reverse direction at a preset RPM. Then, after a preset time period, the motor 3 is turned off again for decelerating and stopping the motor 3. This regular or reverse direction rotation control of the motor 3 by the computing/controlling unit 1 is conducted repeatedly until an entire washing is completed. That is, as the regular and reverse direction rotations are repeated, a strong mechanical friction occurs between the pulsator and the laundry.

In the meantime, as shown in a flow chart in FIG. 3, the spinning cycle of the washing machine has an error determining step S11~S13 for comparing a number PC of times of attempts for detecting a cloth amount and a preset reference number to determine either entry into a spring cycle or an occurrence of an unbalance error, a laundry disentangling step S21 and S22 for, when the entry into the spinning cycle is determined in the error determining step S11~S13, for rotating the drum in a reverse direction at a speed in conducting a laundry disentangling cycle, and, after a preset time period, measuring a RPM change to detect cloth amount in the drum, an eccentricity determining step S31 and S32 for rotating the drum in a regular direction at a speed to measure an eccentricity based on the RPM change and compare a preset reference eccentricity and measured eccentricity to determine an eccentricity pass, a laundry re-disentangling step S41 for selectively conducting the error determining step S11~S13 or the eccentricity determining step S31 and S32 according to a result of the eccentricity determining step S31 and S32, and a main spinning step S51 for selectively spinning the drum at a specific RPM according to a result of the eccentricity determining step S31 and S32 to extract water from the laundry in the drum.

When the spinning cycle is started, a number PC of times of cloth amount detecting attempts is counted and stored in the computing/controlling unit 1. The computing/controlling unit 1 then compares a preset reference number of times (for example, 40 times) to the number PC of times of the cloth amount detecting attempts counted, and, if a laundry disentangling step is going on more than the reference number, a laundry unbalance state in the drum is determined to display an unbalance error on a display unit (not shown) and control various peripheral devices to stop all the operation of the washing machine S11~S13. In this instance, if the computing/controlling unit 1 determines the number PC of times of cloth amount detecting attempts is below a reference number of times, the motor 3 is controlled through the motor driving unit 2 to carry out the laundry disentangling cycle S21 in which the drum is rotated in a reverse direction at a preset RPM. At the same time, a RPM change is measured after a preset time period from the time when the drum is rotated at a constant RPM in the laundry disentangling step S22.

That is, as shown in FIGS. 2 and 4, a RPM change is measured to detect a cloth amount at a time point "A" after elapse of a preset time period from the laundry disentangling step by rotating the drum in a reverse direction at "II" RPM (for example, 50 RPM). If a Hall sensor generates ten pulses in one rotation of the motor 3 and a number of the pulses are stored at every one second, the RPM at every one second can be obtained. If 100 pulses are sensed for a first one second and 150 pulses are sensed for the next one second, the first 10 revolution per a second equals 600 RPM and the next 15 revolution per a second equals 900 RPM. For example, if a time period of the drum rotation per one pulse is 100 msec, we can obtain $10^2 \times 10^{-3} \times 60 = 600$ RPM. And, even though the computing/controlling unit 1 controls the drum to be at "II" RPM, the drum may rotate at a RPM deviated from the "II" RPM depending on the cloth amount. That is, in the "II" RPM when the laundry rotates independent of the drum with a position change of the laundry as the drum rotates, a fall of the laundry from "III" in FIG. 4 to a bottom of the drum causes a speed difference. When the laundry falls from "III" to the bottom, the RPM change is great if the cloth amount in the drum is little and the RPM change is little if the cloth amount in the drum is great because falling of the laundry is continuous. As an example, as shown in FIG. 4, if laundry presents only at "a" in the drum, it will take much time for the laundry to reach to "III" again after the laundry falls down from the "III" to the bottom, and a drum speed when the laundry moves toward "III" and a drum speed when the laundry falls from "III" will be different. However, laundries present at "a", "b" and "c" respectively, as laundries at "b" and "c" keep moving toward "III" after a laundry falls down from "III", there is not a great speed change. Accordingly, a cloth amount in a drum can be detected utilizing a principle of a RPM change according to the cloth amount.

Next, at "B" in FIG. 2, the computing/controlling unit 1 raises RPM of the motor 3 to "I" RPM for determining proceeding to the spinning cycle, which is a RPM when the laundry rotates together with the drum. In this instance, an eccentricity is measured based on a RPM change sensed by the speed sensing unit 4 at "C" while the motor 3 is under constant speed control (S31). Then, the measured eccentricity and a preset reference eccentricity are compared to determine an eccentricity pass (S32). If a result of the eccentricity comparison turns out that proceeding into a main spinning is not allowable, the number PC of times of cloth amount detecting attempts is increased by unity and compared to the preset reference number (40 time, for example), to carry out the disentangling cycle again according to a result of the comparison. If the result of the eccentricity comparison turns out that proceeding into a main spinning is allowable, the drum is rotated in a specific RPM, to carry out a main spinning in which the laundries in the washing tub are extracted of water (S51).

In the meantime, it is required to set an adequate time period from the laundry disentangling step to the time point "A", being a cloth amount detecting time point, in the cloth amount measuring step (S22), if not, an occurrence of error in the cloth amount detection is highly probable. That is, since a span of time between a time point at which the process proceeds into the laundry disentangling step and "A" time point is a time period before the RPM change enters into a converging process, with a great change of RPM, it is highly liable that the cloth amount is determined to be little even if the cloth amount is great due to the great RPM change. Accordingly, the background art method for detecting a cloth amount in a drum washing machine has problems in that much time is required until operation of the washing machine is stabilized and unnecessary laundry disentangling steps are carried out due to occurrence of an eccentricity error in the eccentricity determining step, because, in the background art method, the cloth amount is detected when the RPM is stabilized after application of a certain phase angle to the motor.

SUMMARY OF THE INVENTION

Accordingly, the present invention is directed to a method for detecting a cloth amount in a drum washing machine that substantially obviates one or more of the problems due to limitations and disadvantages of the related art.

An object of the present invention is to provide a method for detecting a cloth amount in a drum washing machine, which can reduce occurrence of error in eccentricity detection.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for detecting a cloth amount in a drum washing machine, the method having a laundry disentangling step in a spinning cycle, includes the steps of (1) counting RPMs of washing machine motor by a measured number of times for each of absolute RPM stages for a time period in the laundry disentangling step and storing counted data, and (2) comparing the data counted by the measured number of times to a cloth amount determining reference value to determine the cloth amount determining reference value at a last position as a laundry disentangling detecting data if the measured number of times is greater than the cloth amount determining reference value.

In other aspect of the present invention, there is provided a method for detecting a cloth amount in a drum washing machine, in which a number of entered times into cloth amount detecting is counted for detecting a cloth amount, the method including a RPM measuring and storing step for measuring RPMs for a preset time period if the number of entered times into cloth amount detecting in a laundry disentangling step is 3 or below 3, counting numbers of times the RPM is reached higher than a preset reference RPM, and storing the measured RPMs in parameters different from one another according to a number of times of cloth amount detecting attempts, a cloth amount level detecting step for comparing multiple stages of preset reference number of time which are references in determining a cloth amount and the reference RPM reached number of times stored in parameters different from one another, and a cloth amount re-detecting step for repeating the RPM measuring and storing step and the cloth amount level detecting step if the counted number of times of cloth amount detecting attempts is within the preset range and is a measured eccentricity is greater than a reference eccentricity.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
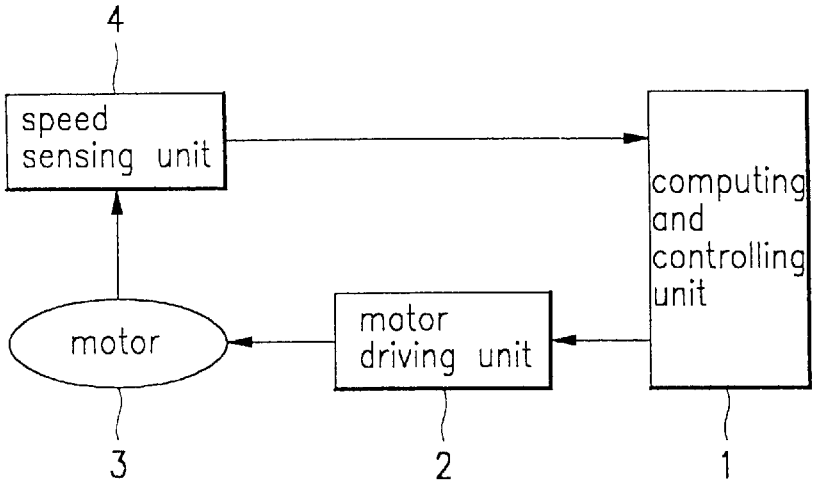
FIG.1 background art
FIG. 1 illustrates a block diagram of a drum driving circuit in a background art drum washing machine.
Figure 2:
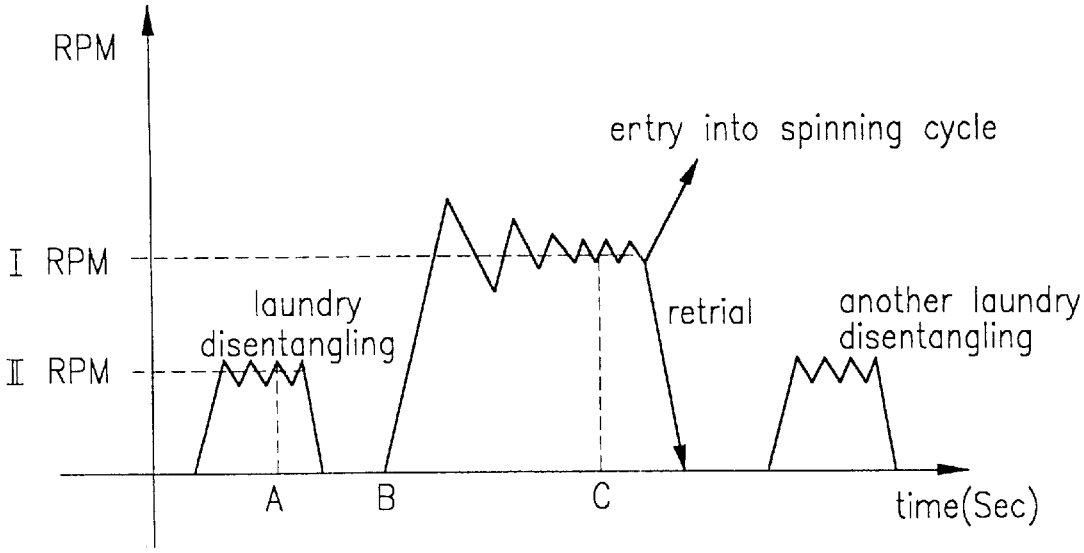
FIG.2 background art
FIG. 2 illustrates a RPM graph in a spinning cycle of a background art drum washing machine.
Figure 3:
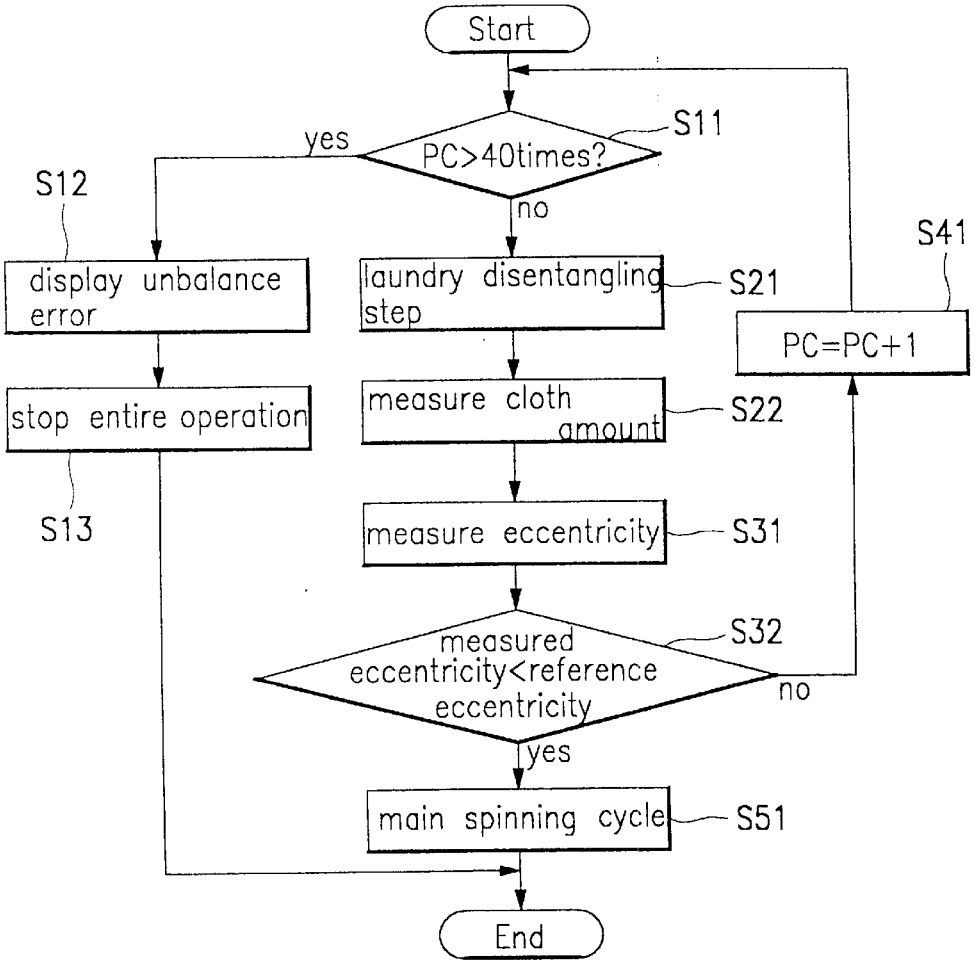
FIG.3 background art
FIG. 3 illustrates a flow chart for explaining a spinning cycle of a background art drum washing machine.
Figure 4:
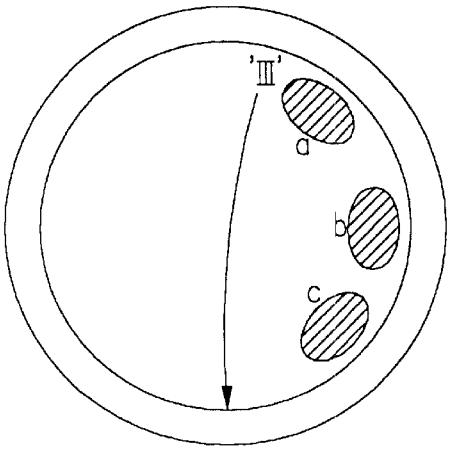
FIG.4 background art
FIG. 4 illustrates examples of locations of laundries during a laundry disentangling process in a drum washing machine.
Figure 5:
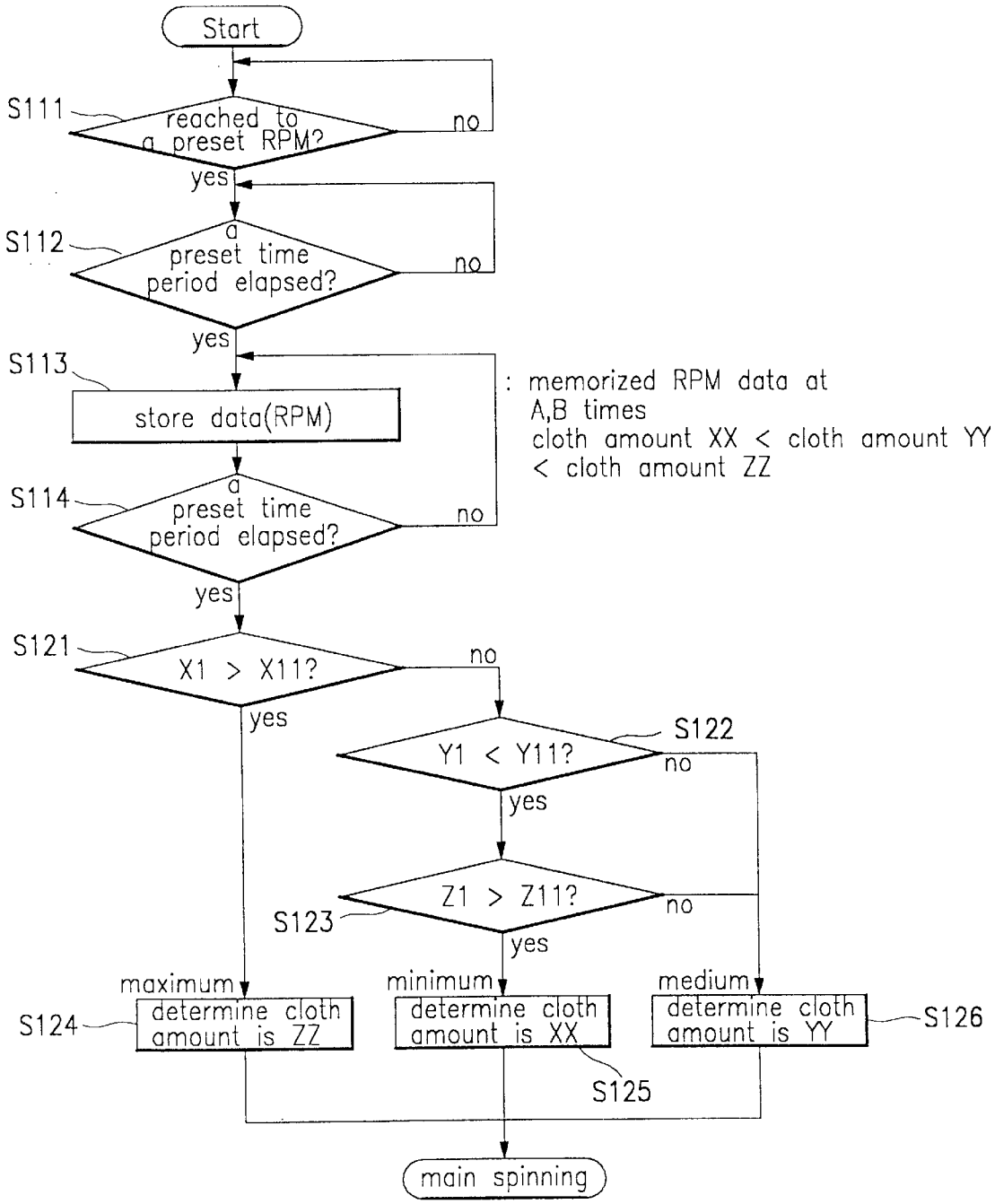
FIG. 5 illustrates a flow chart showing a method for detecting a cloth amount in accordance with one preferred embodiment of the present invention; and, FIG. 6 illustrates a RPM graph in a laundry disentangling cycle in accordance with one preferred embodiment of the present invention.

Reference will now be made in detail to the preferred embodiments of the present invention, examples of which are illustrated in the accompanying drawings. FIG. 5 illustrates a flow chart showing a method for detecting a cloth amount in accordance with one preferred embodiment of the present invention.

Referring to FIG. 5, the method for detecting a cloth amount in accordance with one preferred embodiment of the present invention includes, in a laundry disentangling step, a rotation speed measuring step S111~S114 for measuring a RPM of a drum for a preset time period after elapse of a preset time period from a time when the RPM is reached to a preset RPM and counting particular number of times of the measured RPM for each of preset multiple absolute RPM stages, and a rotation speed comparing step S121~S126 for comparing preset multiple stages of reference numbers of times which are references for determining a cloth amount to the counted particular number of times of the measured RPM for each of the absolute RPM stages to detect a cloth amount.

The operation and advantages of the aforementioned method for detecting a cloth amount in accordance with a preferred embodiment of the present invention will be explained.

During conduction of the laundry disentangling step for a preset time period (for example, 8 seconds), a computing/controlling unit 1 measures a RPM of a drum for a preset time period (for example, 5 seconds), and counts and stores a particular number of times of the measured RPM for each of the multiple absolute RPM stages (S111~S114) after elapse of a preset time period from a time when the computing/controlling unit 1 have confirmation that the RPM sensed through a speed sensing unit 4 is reached to a preset RPM (for example, 50 RPM). As shown in TABLE 1, a plurality of absolute RPM stages are set in advance together with reference values for determining a cloth amount are also set through a basic experiment.

TABLE 1

| Absolute RPM stages | X | Y | Z |
|---|---|---|---|
| measured number of times | X1 | Y1 | Z1 |
| reference value for cloth amount determination | X11 | Y11 | Z11 |

Figure 6:
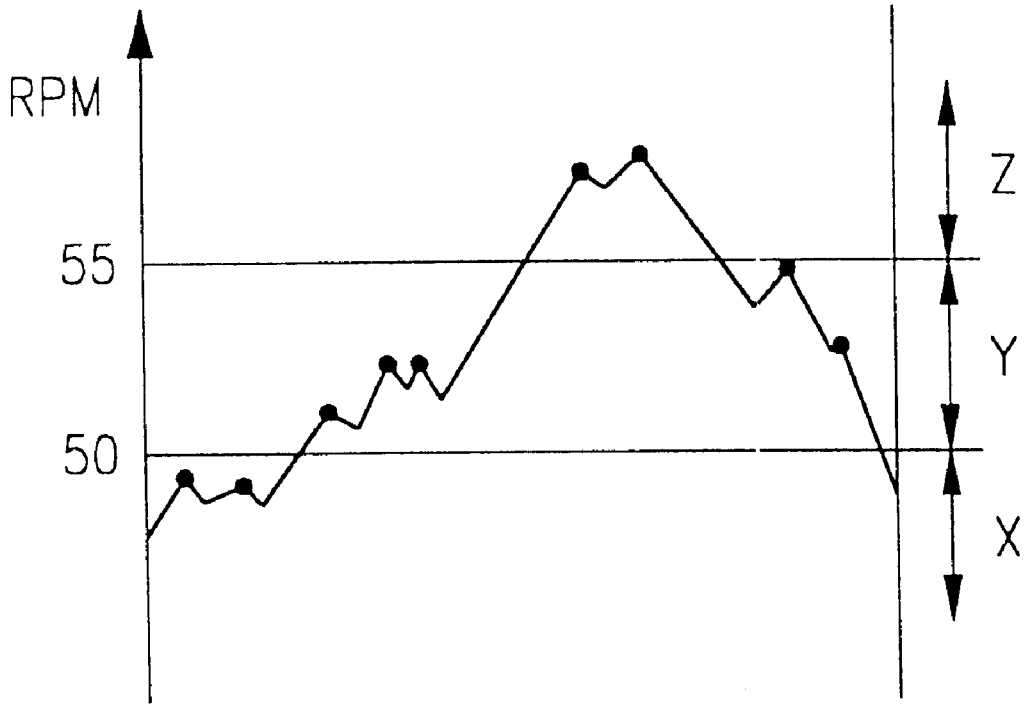

Where, "X" is set to be below 50 RPM, Y is set to be 50~55 RPM, and Z is set to be 55 or higher than 55 RPM. And, reference numbers of times are set for X11, Y11 and Z11, which will be used as references in determining cloth amounts through basic experiment. The reference number of times and measured number of times are RPM peaks counted in a preset time period in the X, Y, and Z RPM stages. For example, when a RPM waveform shown in FIG. 6 is measured through the speed sensing unit 4, a number of RPM peaks X1 measured in the X stage is two, the number of RPM peaks Y1 measured in the Y stage is five, and the number of RPM peaks Z1 measured in the Z stage is two. Accordingly, the computing/controlling unit 1 counts numbers of RPM peaks measured in each of the X, Y, and Z absolute RPM stages for five seconds among the 8 seconds of laundry disentangling cycle and stores the numbers as X1, Y1 and Z1. Next, upon completion of the RPM measurement as a preset time period is elapsed in the laundry disentangling step, the computing/controlling unit 1 compares the stored number of times to multiple stages of the preset cloth amount determining reference values (reference number of times) for each of the absolute RPM stages to detect the cloth amount (S121~S126). Under a condition of X1>X11 being satisfied, if the number of RPM peaks is greater than a reference value at RPMs below 50, which implies that RPM is stable due to a large amount of the cloth, this case is determined to be a case of a greatest cloth amount ZZ (S121 and S124). Opposite to this, if the condition of X1>X11 is not satisfied, a condition of satisfying X1<X11 is determined. If satisfied, the case is when the RPM change is minimum if Z1>Z11, the case is determined to be a case of a minimum cloth amount XX (S122, S123, and S125). And, in the case when both the conditions X1>X11 and Z1>Z11 are not satisfied, the case is determined to be a case of a medium cloth amount YY (S126). In TABLE 1, it is only an exemplary that the absolute RPM stages are set to be X, Y and Z, the cloth amount determining reference values are set to be X11, Y11 and Z11, and the cloth amount levels are classified as XX, YY and ZZ in the steps S124, S125 and S126. If the absolute RPM stages, the cloth amount determining reference values and the cloth amount levels are divided more finely, though the rotation speed comparison steps are diversified and complicated over the steps S121~S126, preciseness of the cloth amount detecting value can be improved.

Figure 7A:
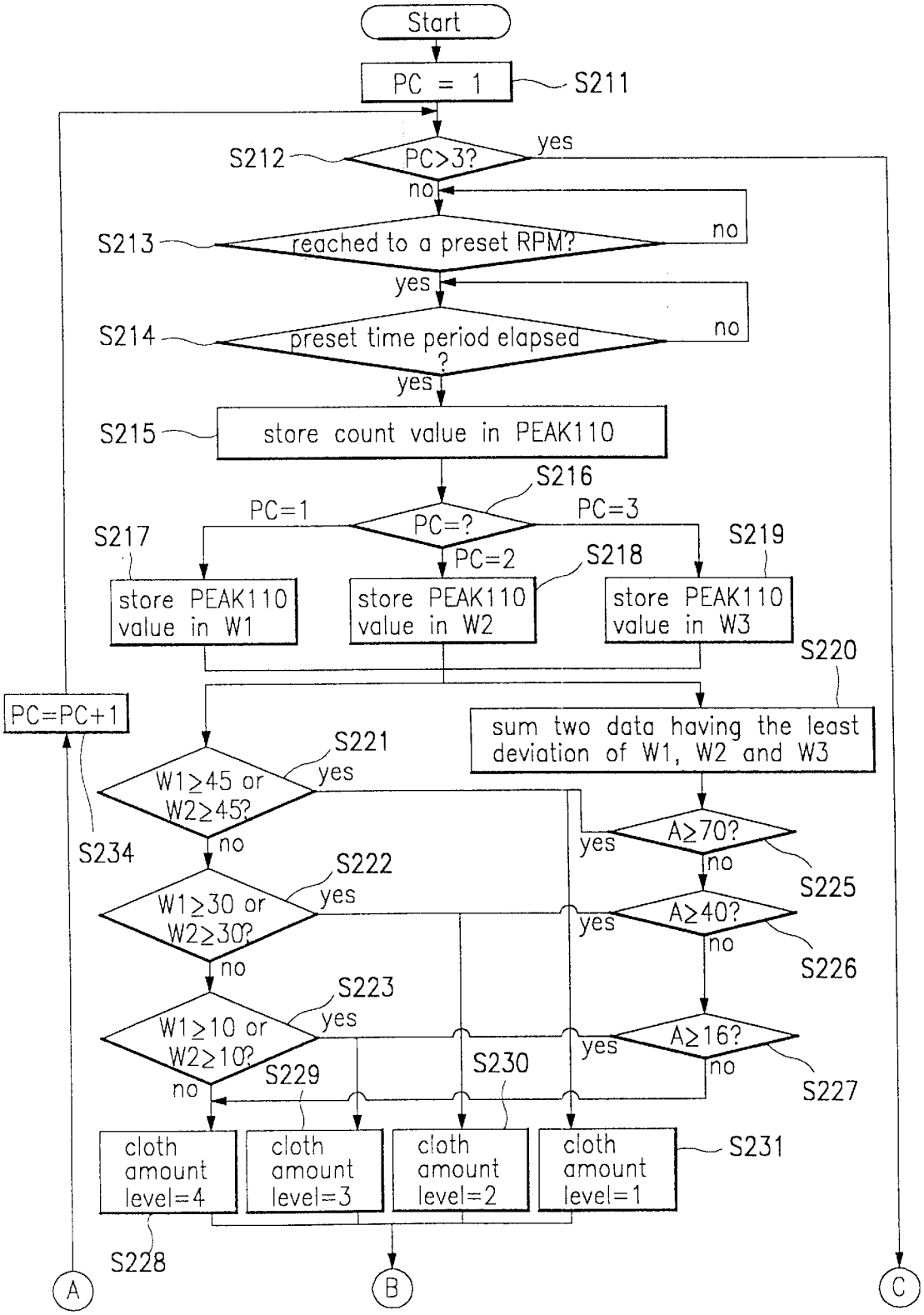
FIGS. 7A and 7B illustrates a flow chart showing a method for detecting a cloth amount in accordance with another preferred embodiment of the present invention.
Figure 7B:
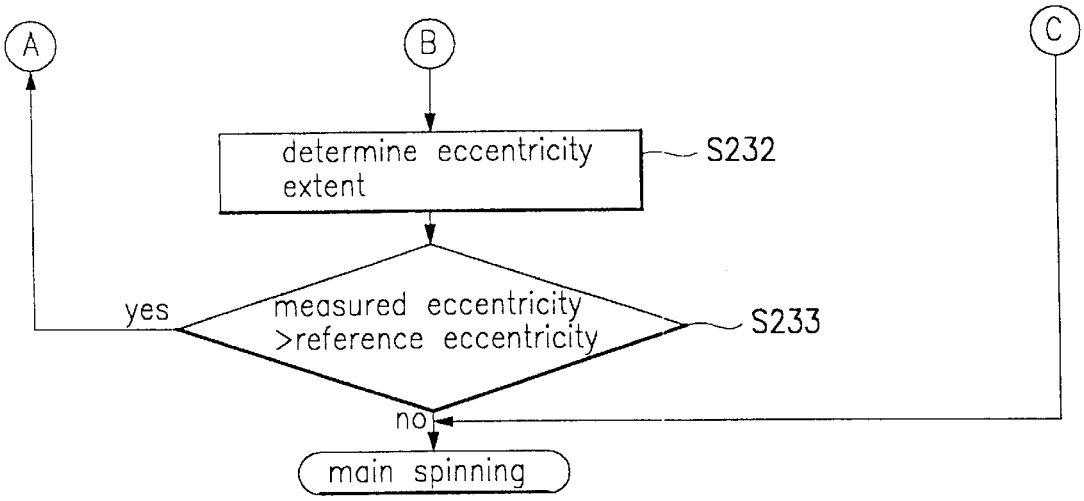

FIGS. 7A and 7B illustrates a flow chart showing a method for detecting a cloth amount in accordance with another preferred embodiment of the present invention, including, before proceeding into a main spinning cycle, a RPM measuring and storing step, and a cloth amount level detecting step, and further including a cloth amount re-detecting step if the counted number of times of cloth amount detecting attempts is not within the preset number of times.

Referring to FIG. 7, the method for detecting a cloth amount in accordance with another preferred embodiment of the present invention includes, in the laundry disentangling step, a rotating speed measuring step S211~S220 for measuring RPM for a preset time period to count a number of times the RPM reaches to a preset reference RPM and storing in the number to parameters different from one another according to a number of times PC entered into cloth amount detection, a rotation speed comparing step S221~S231 for comparing multistages of preset reference numbers of times which are references for determining a cloth amount and the number of times the RPM reached to a reference RPM stored in the parameters different from one another, to detect the cloth amount, and a step S233 and S234 for, when the number PC of times of the counted cloth amount detection attempts is within a preset range, determining an extent of eccentricity for carrying out the rotation speed measuring step S212~S220 and the rotation speed comparing step S221~S231 again and counting from a second cloth amount detecting attempt. The rotation speed measuring step S211~S220 includes a reference RPM reached number of times calculation step S211~S215 for, when a preset time period is elapsed after a RPM of the drum is reached to a preset RPM, measuring RPM for a preset time period and calculating a number of time the RPM is reached to the preset reference RPM, and a reference RPM reached number of times storing step S216~S219 for counting a number PC of times of cloth amount detecting attempts and storing the reached number of times in parameters different from one another according to the number PC of entered times into the cloth amount detection when the counted number PC of entered times into cloth amount detection is within a preset range, and further includes, when the number of entered times into cloth amount detection is the same with the preset reference value, a minimum deviation reached number of times storing step (S220), for combining two reached number of times having a minimum deviation from each other of the plurality of reached numbers of times stored in the parameters different from one another and storing in another parameter. Of various fashion of combining the two reached number of times which have a minimum deviation, this embodiment suggests to sum the two values. The rotation speed comparing step S221~S231 includes a lower number of times cloth amount detecting step S221~S223 and S228~S231 for, when the number PC of times of cloth amount detecting attempts is a number of times except the greatest number of times among the preset ranges, comparing each of the reference RPM reached number of times to the preset reference number of times to detect the cloth amount, and a greatest number of times cloth amount detecting step S225~S227 and S228~S231 for summing two data having the least deviation among the different parameter values W1, W2 and W3 and storing another parameter A, and comparing a preset number of reference RPMs selected from the reference RPM reached number of times, the parameter A and the preset reference number of times (for example, 70, 40 and 16), to detect the cloth amount.

The operation and advantages of the method for detecting a cloth amount of the present invention will be explained.

The computing/controller unit 1 provides "1" as an initial value for the number of times of cloth amount detecting attempts during conducting the laundry disentangling step after elapse of a preset time period (for example, 8 seconds), and measures a drum RPM sensed through the speed sensing unit 4 for a preset time period after elapse of a preset time period again from a time when the RPM reaches to a preset RPM (for example, 50 RPM), during which a reference RPM reached number of times which is a number of times the drum RPM reaches to a preset reference RPM (for example, 57 RPM) is calculated and stored in a parameter "PEAK 110" (S211~S215). The computing/controller unit 1 then determines a number of times of cloth amount detecting attempts; as an initial value is "1" at first, the reference RPM reached number of times stored in "PEAK 110" is stored in a parameter W1 (S216 and S217). Next, the reference RPM reached number of times stored in the parameter W1 and preset multistages of reference numbers of times are compared to detect the cloth amount. That is, if a condition of W1≧45 is satisfied, the cloth amount is detected to be at I level. And, if not, satisfaction of a condition of W1≧30 is determined, and the cloth amount is detected to be at 2 level if satisfied. And, if not, satisfaction of a condition of W1≧10 is determined, and the cloth amount is detected to be at 3 level if satisfied. And, if not, the cloth amount is detected to be at 4 level (S217~S231). Then, the detected levels are stored in the computing/controller unit 1. In the next step (S232–S233), the number of entering times into cloth amount detecting is determined again to proceed to a main spinning if the number of entering times into cloth amount detecting is below the reference number of time, and, if not, to repeat the aforementioned steps, in which the RPM is measured again to detect the cloth amount again if the number PC of times of cloth amount detecting attempts is smaller than the preset number of times (4 times), in advance which "1" is added to the initial value of the number of times of cloth amount detecting attempts (S232~S233). The RPM is then measured for a preset time period again, to calculate the reference RPM reached number of times which is a number of time the RPM reaches to a preset reference RPM (for example, 57 RPM) and store in "PEAK 110" (S215). Then, the computing/controller unit 1 determines the number PC of times of cloth amount detecting attempts, adding "1" to the initial value in the foregoing step (S234) to make "2" and storing the reference RPM reached number of times stored in the "PEAK 110" in W2 (S216~S218). The reference RPM reached number of times stored in the parameter W2 is compared to the preset multistages of reference number of times, to detect the cloth amount. That is, if a condition of W2≧45 is satisfied, the cloth amount is detected to be at 1 level. And, if not, satisfaction of a condition of W2≧30 is determined, and the cloth amount is detected to be at 2 level if satisfied. And, if not, satisfaction of a condition of W2≧10 is determined, and the cloth amount is detected to be at 3 level if satisfied. And, if not, the cloth amount is detected to be at 4 level (S217~S231). Then, the detected levels are stored in the computing/controller unit 1, and the process proceeds to a main spinning if the number PC of times of cloth amount detecting attempts is absolute value "4" or above "4", and, if not, the process proceeds to repeat the aforementioned steps, in which the RPM is measured again to detect the cloth amount since the number PC of times of cloth amount detecting attempts is smaller than the preset number of times (4 times) as the number of times of cloth amount detecting attempts is "2" and "1" is added to a prior number of times of cloth amount detecting attempts (S234). The RPM is then measured for a preset time period again, to calculate the reference RPM reached number of times which is a number of times the RPM reaches to a preset reference RPM (for example, 57 RPM) and store in "PEAK 110" (S215). Then, upon detection of the number PC of times of the cloth amount detecting attempts being "3", the computing/controller unit 1 stores the reference RPM reached number of times stored in the "PEAK 110" in W3 (S216~S219). Thus, the reference RPM reached numbers of times are respectively stored in W1, W2 and W3 according to the aforementioned steps, and the computing/controller unit 1 sums two data having a minimum deviation between them and stores in a parameter "A" (S220) for a more precise cloth amount detection. The reference RPM reached number of times stored in the parameter "A" is compared to the preset multistages of reference number of times to detect the cloth amount. That is, if a condition of A≧70 is satisfied, the cloth amount is detected to be at 1 level, and, if not, satisfaction of a condition of A≧40 is determined, if yes, the cloth amount is detected to be at 2 level. And, if not, satisfaction of a condition of A≧16 is determined, and, if yes, the cloth amount is detected to be at 3 level. And, if not, the cloth amount is detected to be at 4 level (S225~S227). If the number of times of cloth amount detecting attempts are the same with the preset number of times (3 times), no more cloth amount detection is made, but the process proceeds to the main spinning cycle.

Since, in a spinning cycle, cloth amount levels are established according to measured changes of washing machine motor RPM before proceeding into a main spinning cycle to proceed into the main spinning cycle, the method for detecting a cloth amount in a drum washing machine of the present invention can reduce noise from the washing machine.

It will be apparent to those skilled in the art that various modifications and variations can be made in the method for detecting a cloth amount is a drum washing machine of the present invention without departing from the spirit or scope of the invention. Thus, it is intended that the present invention cover the modifications and variations of this invention provided they come within the scope of the appended claims and their equivalents.

What is claimed is:

1. A method of detecting a load level in a washing machine, comprising the steps of:

(a) detecting a number of times that a rotational speed of a motor of the washing machine exceeds a predetermined reference speed;

(b) storing the detected number of times in a variable as a count value;

(c) comparing a count value to at least one count reference number;

(d) determining an amount of cloth in the washing machine based on the results of the comparing step; and (e) repeating steps (a)–(d) if an eccentricity of the washing machine exceeds a predetermined eccentricity and the number of repetitions of steps (a)–(d) does not equal a predetermined number of repetitions.

2. The method of claim 1, wherein step (b) comprises storing the detected number of times in a different count variable each time step (b) is repeated.

3. The method of claim 2, wherein the comparing step comprises comparing a count value to a first count reference number, and wherein the determining step comprises determining that the load level in the washing machine is at a first level when the count value is greater than or equal to the first count reference number.

4. The method of claim 3, wherein the comparing step further comprises comparing the count value to a second count reference number if the count value is less than the first count value, and wherein the determining step comprises determining that the load level in the washing machine is at a second level when the count value is greater than or equal to the second count reference number.

5. The method of claim 4, wherein the comparing step further comprises comparing the count value to a third count reference number if the count value is less than the second count reference number, and wherein the determining step comprises determining that the load level in the washing machine is at a third level when the count value is greater than or equal to the third count reference number.

6. The method of claim 5, wherein the determining step further comprises determining that the load level in the washing machine is at a fourth level if the count value is less than the third count reference number.

7. The method of claim 2, wherein during at least one repetition of step (c), the count value that is compared to at least one count reference number is a sum of at least two count variables.

8. The method of claim 7, wherein the at least one repetition of step (c) is the last repetition of step (c) before the number of repetitions of steps (a)–(d) equals the predetermined number of repetitions.

9. The method of claim 7, wherein the count value is a sum of two count variables that have the least amount of deviation from one another among all stored count variables.

10. The method of claim 1, wherein step (a) is performed a predetermined amount of time after a rotational speed of the motor reaches a predetermined rotational speed.

* * * * *